US008378941B2

(12) United States Patent
Kim

(10) Patent No.: US 8,378,941 B2
(45) Date of Patent: Feb. 19, 2013

(54) LIQUID CRYSTAL DISPLAY DEVICE AND METHOD OF DRIVING THE SAME

(75) Inventor: Min-Kyu Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 763 days.

(21) Appl. No.: 12/500,179

(22) Filed: Jul. 9, 2009

(65) Prior Publication Data

US 2010/0134477 A1 Jun. 3, 2010

(30) Foreign Application Priority Data

Dec. 1, 2008 (KR) ..... 10-2008-0120572

(51) Int. Cl.
*G09G 3/36* (2006.01)

(52) U.S. Cl. ..... 345/87; 345/99; 345/102; 345/204; 382/168

(58) Field of Classification Search ..... 345/87–102, 345/204–214; 382/168–172, 282–283; 348/671–673
See application file for complete search history.

(56) References Cited

U.S. PATENT DOCUMENTS

2001/0036312 A1* 11/2001 Shigeta et al. ..... 382/168
2005/0140640 A1* 6/2005 Oh et al. ..... 345/102
2005/0231457 A1* 10/2005 Yamamoto et al. ..... 345/102
2008/0238840 A1* 10/2008 Raman et al. ..... 345/84
2009/0002404 A1* 1/2009 Barnhoefer et al. ..... 345/690
2009/0115907 A1* 5/2009 Baba et al. ..... 348/672

* cited by examiner

*Primary Examiner* — Hong Zhou
(74) *Attorney, Agent, or Firm* — Morgan, Lewis & Bockius LLP

(57) ABSTRACT

A liquid crystal display device includes a power consumption reduction portion that analyzes a histogram of first image data of an image and generates second image data and a first luminance control signal, wherein, when the image includes an irrelevance region which is substantially irrelevant to degradation of display quality, the power consumption reduction portion analyzes a histogram of first image data of other region of the image except for an excluded region, and wherein the excluded region includes at least the irrelevance region; a timing controller that is supplied with the second image data and the first luminance control signal and generates gate control signals, data control signals and a second luminance control signal; a gate driving portion that generates gate voltages using the gate control signals; a data driving portion that generates data voltages using the second image data and the data control signals; a liquid crystal panel that displays the image using the gate voltages and the data voltages; a backlight control portion that generates a backlight control signal using the second luminance control signal; and a backlight unit that supplies light according to the backlight control signal.

8 Claims, 7 Drawing Sheets

FIG. 1 -- RELATED ART

LIQUID CRYSTAL DISPLAY DEVICE AND METHOD OF DRIVING THE SAME

The present invention claims the benefit of Korean Patent Application No. 2008-0120572, filed in Korea on Dec. 1, 2008, which is hereby incorporated by reference for all purposes as if fully set forth herein.

BACKGROUND OF THE INVENTION

1. Field of the Invention

The present invention relates to a liquid crystal display device, and more particularly, to a liquid crystal display (LCD) device and a method of driving the same.

2. Discussion of the Related Art

Until recently, display devices have typically used cathode-ray tubes (CRTs). Presently, many efforts and studies are being made to develop various types of flat panel displays, such as liquid crystal display (LCD) devices, plasma display panels (PDPs), field emission displays, and electro-luminescence displays (ELDs), as a substitute for CRTs. Of these flat panel displays, LCD devices have many advantages, such as high resolution, light weight, thin profile, compact size, and low voltage power supply requirements.

In general, an LCD device includes two substrates that are spaced apart and face each other with a liquid crystal material interposed between the two substrates. The two substrates include electrodes that face each other such that a voltage applied between the electrodes induces an electric field across the liquid crystal material. Alignment of the liquid crystal molecules in the liquid crystal material changes in accordance with the intensity of the induced electric field into the direction of the induced electric field, thereby changing the light transmissivity of the LCD device. Thus, the LCD device displays images by varying the intensity of the induced electric field.

FIG. 1 is a block diagram of a LCD device according to the related art.

Referring to FIG. 1, the LCD device 10 includes a liquid crystal panel 20 displaying images, a backlight unit 30 supplying light to the liquid crystal panel 20, a driving circuit portion 40 operating the liquid crystal panel 20 and the backlight unit 30.

The liquid crystal panel 20 includes first and second substrates facing each other and a liquid crystal layer between the first and second substrates. The liquid crystal panel 20 includes a plurality of gate lines GL1 to GLn along a first direction and a plurality of data lines DL1 to DLm along a second direction. The plurality of gate lines GL1 to GLn and the plurality of data lines DL1 to DLm cross each other to define a plurality of sub-pixel regions. In each sub-pixel region, a thin film transistor T, a liquid crystal capacitor Clc and a storage capacitor Cst are formed.

The backlight unit 30 is below the liquid crystal panel 20 and supplies light to the liquid crystal panel 20 according to control of the driving circuit portion 40.

The driving circuit portion 40 includes a timing controller 50, a gate driving portion 70 and a data driving portion 60. Each of the gate driving portion and the data driving portion includes a plurality of drive ICs.

The timing controller 50 is supplied with signals and image data from an external system and generates control signals to control the gate driving portion 70, the data driving portion 60, and the backlight unit 30. The control signals and the image data are supplied to the corresponding component of the gate driving portion 70, the data driving portion 60, and the backlight unit 30.

The gate driving portion 70 performs ON/OFF operations of the thin film transistors T in response to the control signals from the timing controller 50. The gate lines GL1 to GLn are sequentially scanned by one row line each for one horizontal period. For the horizontal period, the corresponding thin film transistors T are turned on, and data voltages for the corresponding row line pass through the thin film transistors T and applied to the liquid crystal capacitors Clc and the storage capacitors Cst.

The data driving portion 60 selects a reference voltage corresponding to the image data. The selected reference voltage is applied as the data voltage to the liquid crystal panel 20.

Recently, driving methods to reduce a power consumption of the backlight unit 30 have been proposed. The driving methods minimize a luminance of a backlight unit 30 for a low gray level, and more particularly, a luminance for a black. Accordingly, a power consumption of the backlight unit 30 is reduced, and a contrast ratio of the LCD device is improved. Further, by using the driving methods, a dynamic contrast ratio is improved. In other words, when images are displayed for a plurality of frames, brightnesses corresponding to minimum gray levels of the images are reduced, and thus the dynamic contrast ratio is improved.

Of these driving methods, there is a driving method that performs a gray level conversion for an image data of a low gray level and reduces a luminance of a backlight unit, thus displays an image having substantially the same brightness as an image displayed by a normal mode. In this driving method, a correlation analysis between a brightness of an input image data and a luminance of a backlight unit is performed, and according to the correlation analysis, the image data is converted and supplied to a liquid crystal panel and the luminance of the backlight unit is reduced.

However, in case of displaying an image including a plurality of image data of high gray levels, when an image data conversion is performed, image data of more than a predetermined gray level are all saturated and have in common a maximum gray level. Accordingly, display quality may be degraded.

To prevent this problem, for a particular image including image data, a number of which is equal to or more than a reference number and which each have a gray level equal to or more than a reference gray level, an image data conversion and a luminance reduction of a backlight unit are not performed, and a normal mode which does not make the image data conversion and the luminance reduction is performed. For other type of image, the image data conversion and the reduction of luminance are performed. However, since the particular image is not operated in a power consumption reduction mode, reduction of power consumption is limited.

SUMMARY OF THE INVENTION

Accordingly, the present invention is directed to a liquid crystal display device and a method of driving the same that substantially obviates one or more of the problems due to limitations and disadvantages of the related art.

An advantage of the present invention is to provide a liquid crystal display device and a method of driving the same that can improve power consumption.

Additional features and advantages of the present invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described herein, a liquid crystal display device includes a power consumption reduction portion that analyzes a histogram of first image data of an image and generates second image data and a first luminance control signal, wherein, when the image includes an irrelevance region which is substantially irrelevant to degradation of display quality, the power consumption reduction portion analyzes a histogram of first image data of other region of the image except for an excluded region, and wherein the excluded region includes at least the irrelevance region; a timing controller that is supplied with the second image data and the first luminance control signal and generates gate control signals, data control signals and a second luminance control signal; a gate driving portion that generates gate voltages using the gate control signals; a data driving portion that generates data voltages using the second image data and the data control signals; a liquid crystal panel that displays the image using the gate voltages and the data voltages; a backlight control portion that generates a backlight control signal using the second luminance control signal; and a backlight unit that supplies light according to the backlight control signal.

In another aspect, a method of driving a liquid crystal display device includes detecting whether or not an image having first image data includes an irrelevance region, wherein the irrelevance region is substantially irrelevant to degradation of display quality; analyzing a histogram of first image data of other region of the image except for an excluded region when the image includes the irrelevance region and a histogram of first image data of a whole region of the image when the image does not include the irrelevance region, wherein the excluded region includes at least the irrelevance region; generating second image data and a first luminance control signal according to the histogram analysis; displaying the image on a liquid crystal panel using the second image data; and supplying light from a backlight unit to the liquid crystal panel using the first luminance control signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to illustrated embodiments of the present invention, which are illustrated in the accompanying drawings.

Figure 1:
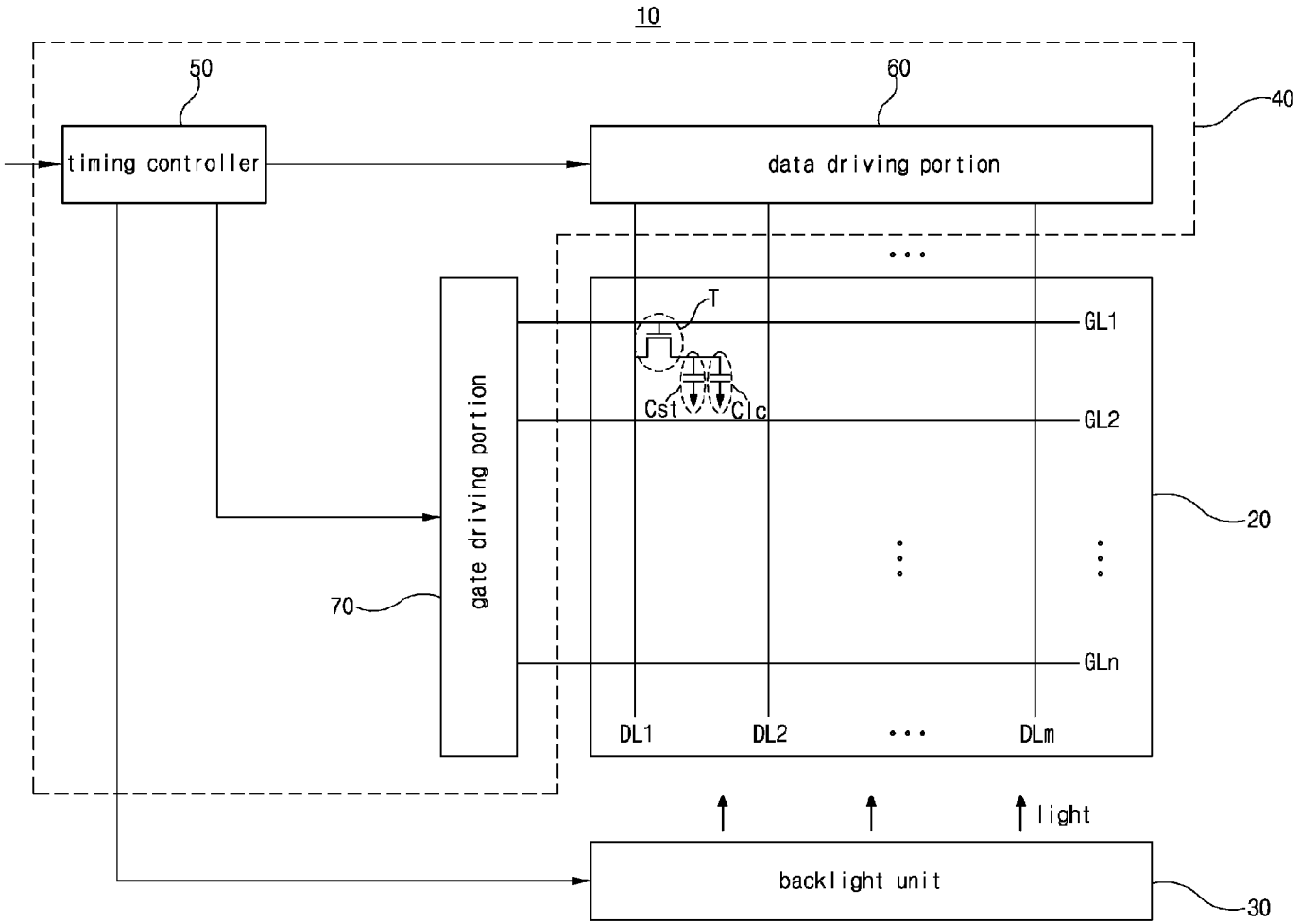
FIG. 1 is a block diagram of a LCD device according to the related art.
Figure 2:
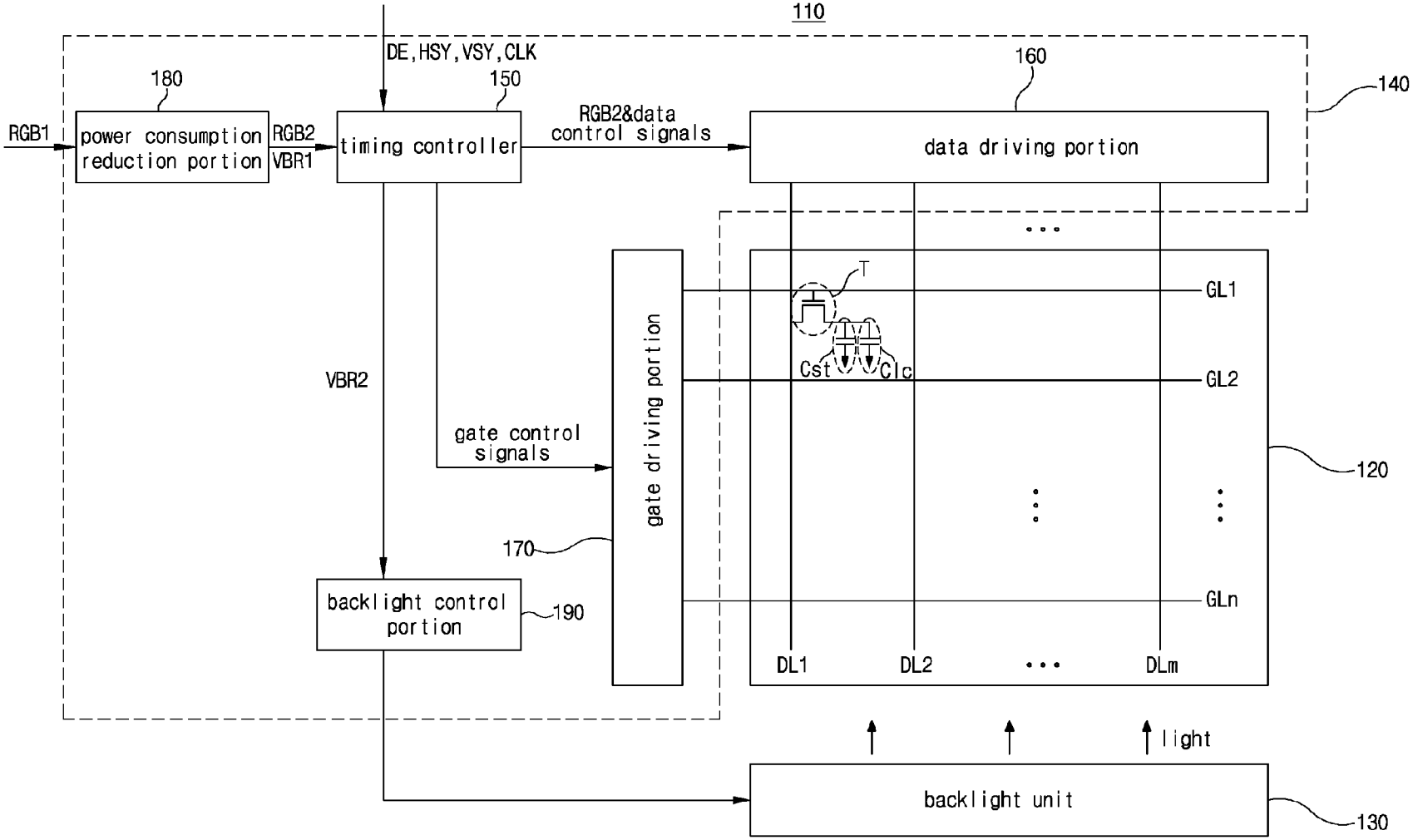
FIG. 2 is a block diagram of an LCD device according to a first embodiment of the present invention.

FIG. 2 is a block diagram of an LCD device according to a first embodiment of the present invention.

Referring to FIG. 2, the LCD device 110 includes a liquid crystal panel 120 displaying images, a backlight unit 130 supplying light to the liquid crystal panel 120, a driving circuit portion 140 operating the liquid crystal panel 120 and the backlight unit 130.

The liquid crystal panel 120 includes first and second substrates facing each other and a liquid crystal layer between the first and second substrates. The liquid crystal panel 120 includes a plurality of gate lines GL1 to GLn along a first direction and a plurality of data lines DL1 to DLm along a second direction. The plurality of gate lines GL1 to GLn and the plurality of data lines DL1 to DLm cross each other to define a plurality of sub-pixel regions in a matrix form. In each sub-pixel region, a thin film transistor T, a liquid crystal capacitor Clc and a storage capacitor Cst are formed. For example, the plurality of sub-pixel regions includes R (red), green (G) and blue (B) sub-pixel regions, and adjacent R, G and B sub-pixel regions may form a pixel region.

The backlight unit 130 is below the liquid crystal panel 120 and supplies light to the liquid crystal panel 120 according to control of the driving circuit portion 140. For example, the backlight unit 130 is controlled according to a backlight control signal, for example, a dimming signal from a backlight control portion 190. The dimming signal adjusts a luminance of light emitted from the backlight unit 130.

The driving circuit portion 140 includes a timing controller 150, a gate driving portion 170, a data driving portion 160, a power consumption reduction portion 180 and the backlight control portion 190. Each of the gate driving portion 170 and the data driving portion 160 includes a plurality of drive ICs.

The power consumption reduction portion 180 is supplied with first image data RGB1 supplied from an external system and generates second image data RGB2 and a first luminance control signal VBR1 using the first image data RGB1. The first image data RGB1 may be data for displaying an image of one frame, and each first image data RGB1 may include R (red), G (green) and blue (B) image data corresponding to R, G and B sub-pixels, respectively.

The timing controller 150 is supplied with the second image data RGB2 and the first luminance control signal VBR1. Further, the timing controller 150 may be supplied with control signals, for example, a data enable signal DE, a vertical synchronization signal VSY, a horizontal synchronization signal HSY and a clock CK supplied from the external system. Using the signals inputted to the timing controller 150, the timing controller 150 generates gate control signals and data control signals and a second luminance control signal VBR2. The gate control signals are supplied to the gate driving portion 170, the data control signals are supplied to the data driving portion 160 along with the second image data RGB2, and the second luminance control signal VBR2 is supplied to the backlight control portion 190.

The gate driving portion 170 performs ON/OFF operations of the thin film transistors T in response to the control signals from the timing controller 150. The gate lines GL1 to GLn are sequentially scanned by one row line each for one horizontal period. For the horizontal period, the corresponding thin film transistors T are turned on, and the image data for the corresponding row line pass through the thin film transistors T and are applied to the liquid crystal capacitors Clc and the storage capacitors Cst.

The data driving portion 160 selects a reference voltage corresponding to the image data. The selected reference voltage is applied as a data voltage to the liquid crystal panel 120. The data voltage is supplied to the corresponding pixel, and liquid crystal molecules corresponding to the pixel are arranged according to the data voltage. When the image data is an 8-bit signal, gray levels of the image data are in a range of 256 levels and the reference voltages are in a range of 256 levels.

The backlight control portion 190 generates the backlight control signal according to the second luminance control signal VBR2 from the timing controller 150, and the backlight control signal is supplied to the backlight unit 130.

The power consumption reduction portion 180 functions to analyze a histogram of the first image data and perform a data conversion and a luminance adjustment. Prior to the histogram analysis, the power consumption reduction portion 180 detects whether or not the image of a frame includes a region which is substantially not degraded in view of display quality. For example, letters included in an image are substantially irrelevant to degradation of display quality. Such the region may be hereinafter called as an irrelevance region. When the irrelevance region is included in the image, the power consumption reduction portion 180 defines an excluded region corresponding to the irrelevance region and analyzes a histogram of a region of the image except for the excluded region. In other words, the power consumption reduction portion 180 excludes the excluded region in analysis on the image. Accordingly, the power consumption reduction portion 180 generates the second image data RGB2 and the first luminance control signal VBR1 according to the histogram of the region of the image except for the excluded region. The excluded region may include at least the irrelevance region.

The power consumption reduction portion 180 and the timing controller 150 may be formed in one chip.

Figure 3:
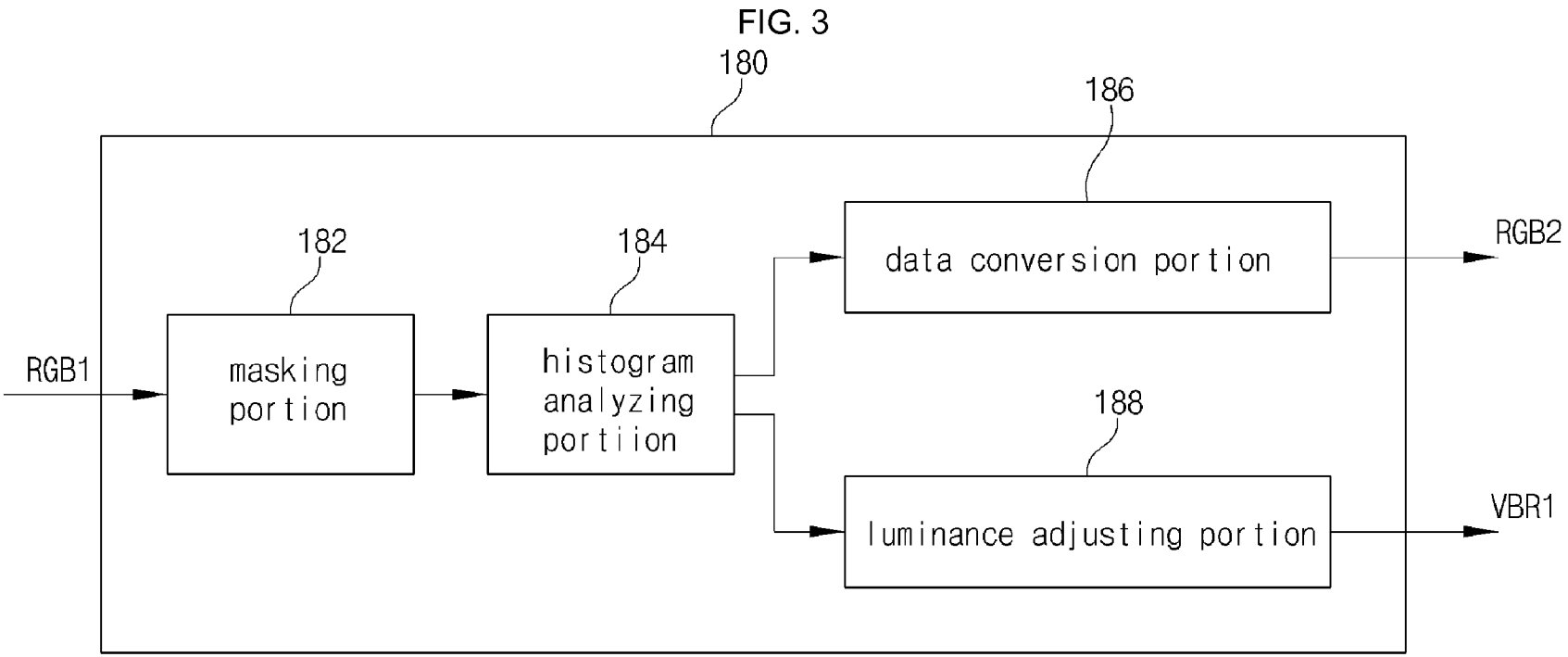
FIG. 3 is a block diagram illustrating the power consumption reduction portion of FIG. 2.

FIG. 3 is a block diagram illustrating the power consumption reduction portion of FIG. 2.

Referring to FIG. 3, the power consumption reduction portion 180 includes a masking portion 182, a histogram analyzing portion 184, a data conversion portion 186 and a luminance adjusting portion 188.

The masking portion 182 verifies whether or not an image of a frame has an irrelevance region. For example, the irrelevance region may be a region where letters such as a caption or a logo of a broadcasting corporation are displayed. The irrelevance region having the letters may usually have a fixed position when the image is displayed. The irrelevance region is hardly degraded in display quality even though the LCD device is operated in a power consumption reduction mode, for example, through a data conversion and a luminance adjustment. After the masking portion 182 checks the image, when the image does not include the irrelevance region, the masking portion 182 transfers a gray level information of the image data of a whole region of the image to the histogram analyzing portion 184. When the image includes the irrelevance region, the masking portion 182 defines an excluded region and transfers a gray level information of the image data of a region of the image except for the excluded region to the histogram analyzing portion 184. In other words, when the excluded region exists in the image, the masking portion 182 functions to mask the excluded region such that the excluded region is not considered in a histogram analysis.

The histogram analyzing portion 184 makes a histogram from the gray level information from the masking portion 182. According to the histogram analysis, the histogram analyzing portion 184 determines whether or not operating the power consumption reduction mode. For example, when a number of pixels, which have gray levels equal to or more than a reference gray level, is equal to or more than a reference number, not operating the power consumption reduction mode is determined, and a normal mode is performed without the data conversion and luminance adjustment. When a number of pixels, which have gray levels equal to or more than a reference gray level, is less than a reference number, operating the power consumption reduction mode is determined.

The data conversion portion 186 and the luminance adjusting portion 188 outputs second image data RGB2 and a first luminance control signal VBR1 according to the determination of the histogram analyzing portion 184. For example, when the power consumption reduction mode is OFF, the first image data RGB1 become the second image data RGB2 without the data conversion and the luminance control signal has a value such that the backlight unit (130 of FIG. 2) emits light of a normal luminance. When the power consumption reduction mode is ON, the first image data RGB1 is converted into the second image data RGB2 and the luminance control signal has a value such that the backlight unit emits light of a reduced luminance which is less than the normal luminance. In more detail, when the power consumption reduction mode is ON, a gray level of at least one second image data RGB2 may more than the corresponding first image data RGB1 through the data conversion, and to compensate for the gray level increase of the image data, the luminance may be less than the normal luminance through the luminance adjustment. Accordingly, the brightness of the displayed image in the power consumption reduction mode is substantially the same as the brightness of the displayed image in the normal mode, and the power consumption in the power consumption reduction mode can be reduced compared to the power consumption in the normal mode.

Operations of the power consumption reduction portion 180 are explained in more detail with reference to FIGS. 4 to 6B.

Figure 4:
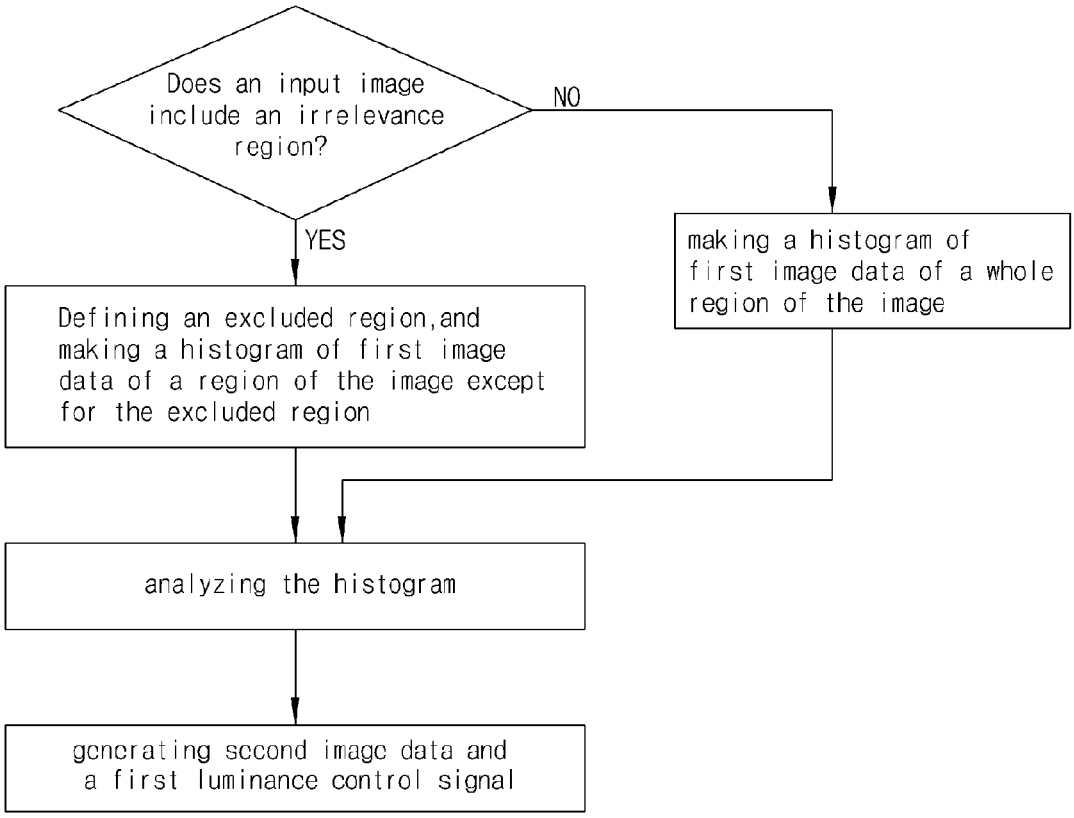
FIG. 4 is a flow chart illustrating operations of the power consumption reduction portion according to the first embodiment of the present invention.
Figure 5A:
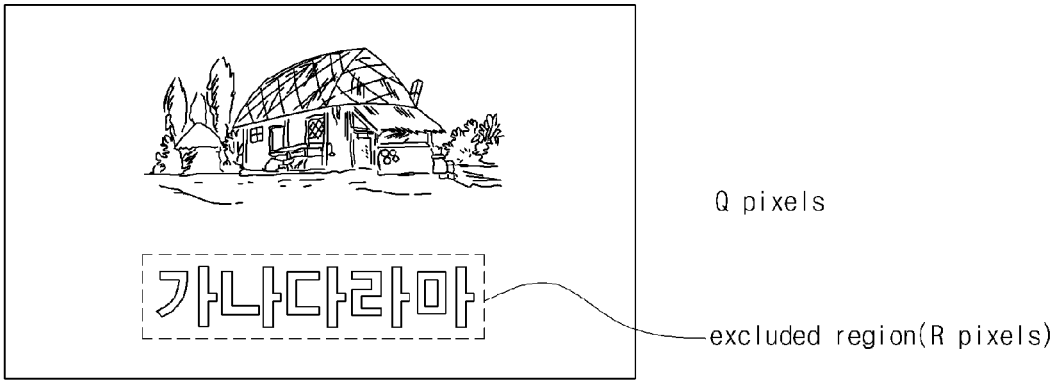
FIG. 5A is a view illustrating an image inputted to the LCD device according to the first embodiment of the present invention.
Figure 5B:
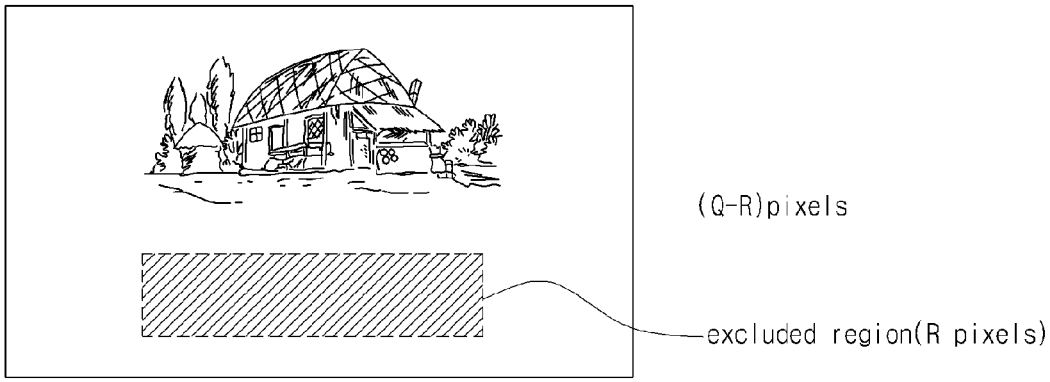
FIG. 5B is a view illustrating an image excluding an excluded region from the image of FIG. 5A.
Figure 5C:
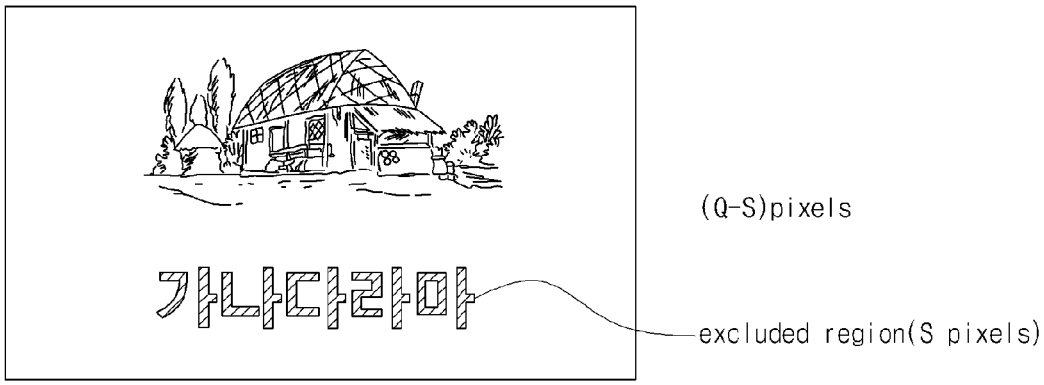
FIG. 5C is a view illustrating an image excluding another excluded region from the image of FIG. 5A.
Figure 6A:
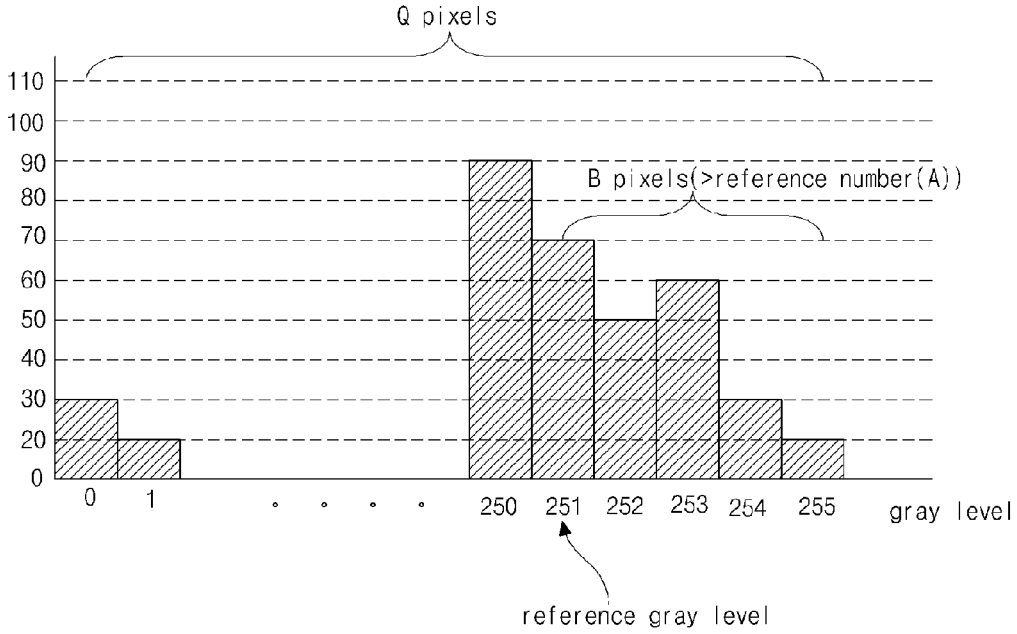
FIGS. 6A and 6B are histograms of images of FIGS. 5A and 5B, respectively.
Figure 6B:
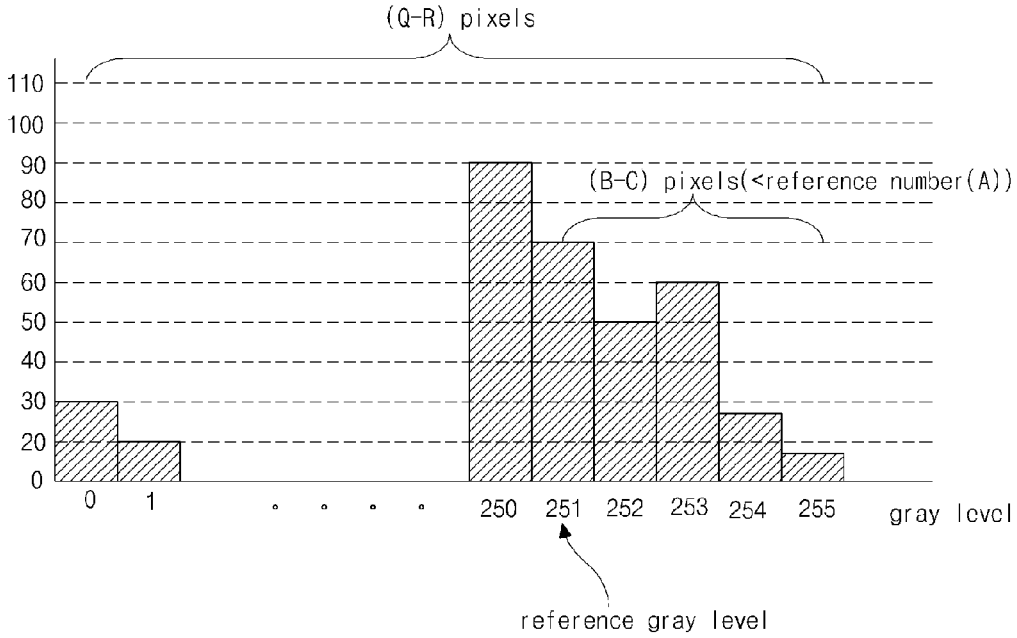

FIG. 4 is a flow chart illustrating operations of the power consumption reduction portion according to the first embodiment of the present invention. FIG. 5A is a view illustrating an image inputted to the LCD device according to the first embodiment of the present invention. FIG. 5B is a view illustrating an image excluding an excluded region from the image of FIG. 5A. FIG. 5C is a view illustrating an image excluding another excluded region from the image of FIG. 5A. FIGS. 6A and 6B are histograms of images of FIGS. 5A and 5B, respectively.

Referring to FIG. 4, the masking portion 182 detects whether or not an input image from an external system includes an irrelevance region, for example, letters such as a caption of a movie or a logo in a TV image provided by a broadcasting corporation. According to the detection of the masking portion 182, a histogram for first image data RGB1 of a whole region of the image or a histogram for first image data RGB1 of a region of the image except for an excluded region is made.

Referring to FIGS. 5A and 5B, the image has totally Q pixels and includes a particular region which is substantially irrelevant to degradation of display quality, for example, an irrelevance region. The masking portion 182 defines an excluded region. For example, the masking portion 182 may define the irrelevance region, where the letters are located, and a predetermined region surrounding the irrelevance region as the excluded region. The excluded region has R pixels, a number of which are more than a number of pixels of the irrelevance region. Accordingly, the masking portion 182 transfers a gray level information of a region, which has (Q−R) pixels, of the image except for the excluded region to the histogram analyzing portion 184.

Alternatively, referring to FIG. 5C, the masking portion 182 may define another excluded region different from the excluded region of FIGS. 5A and 5B. For example, the irrelevance region is itself defined as the excluded region of FIG. 5C. In other words, the masking portion 182 precisely detects the region where the letters are located and defines this region as the excluded region. Accordingly, the excluded region can be minimized. Accordingly, the masking portion 182 transfers a gray level information of a region, which has (Q-S) pixels, of the image except for the excluded region to the histogram analyzing portion 184. A number of the pixels of the excluded region of FIG. 5C is less than a number of the pixels of the excluded region of FIGS. 5A and 5B (i.e., S<R). Accordingly, since the excluded region is minimized in FIG. 5C, the histogram analysis based upon FIG. 5C can more exactly determine whether or not performing the data conversion and luminance adjustment.

Referring again to FIG. 4, the histogram analyzing portion 184 makes a histogram based upon the gray level information supplied from the masking portion 182.

FIG. 6A shows the histogram for the whole region of the image of FIG. 5A. In other words, the histogram of FIG. 6A is made without the masking operation of the first embodiment and even with the excluded region reflected, and is the same as the histogram made according to the related art.

When gray levels have a range of, for example, 256 levels, the pixels of the image are distributed in the range, $0^{th}$ to $255^{th}$ gray levels. For example, when a $251^{st}$ gray level is a reference gray level and A is a reference number, referring to FIG. 6A, a number of pixels B, which have gray levels equal to or more than the $251^{st}$ gray level (i.e., the reference gray level), is more than the reference number A. Accordingly, the histogram analyzing portion 184 determines not performing the data conversion and luminance adjustment. Accordingly, the image is not displayed in the power consumption reduction mode.

However, since the irrelevance region displays the letters to a viewer, this region is substantially irrelevant to degradation of display quality even though the power consumption reduction mode is performed. Accordingly, through the histogram analysis performed for the region except for the excluded region, the image may be displayed in the power consumption reduction mode to reduce the power consumption.

For example, referring to FIG. 6B, the excluded region has R pixels, and out of the R pixels, C pixels may be distributed in a range of gray levels equal to or more than the $251^{st}$ gray level i.e., the reference gray level. Since the irrelevance region has much possibility to have pixels of high gray levels, C has much possibility to be equal to or more than 50% of R pixels. Accordingly, a number of the pixels of the image except for the excluded region is Q−R, and a number of pixels having gray levels equal to or more than the reference gray level is B−C, which may be less than the reference number A (i.e., (B−C)<A).

As described in the first embodiment, when the particular region which is substantially not relevant to degradation of display quality is included in the image to be displayed, the histogram analysis on other region of the image except for the excluded region, which includes at least the particular region, is performed. Accordingly, the power consumption reduction mode can be operated to display the image, and thus the power consumption of the LCD device can be improved.

The irrelevance region may be varied, for example, in at least one of position and size. For example, when a movie is displayed, a caption is usually positioned at center and bottom of a display region of the image. The caption may be varied in size according to a screen for displaying the image. Further, a caption for another movie may be positioned at a different site and/or have a different size. In addition, a logo of a broadcasting corporation is usually positioned at top and at least one of left and right.

In other words, the irrelevance region may be varied in at least one of position and size according to type of image, and another embodiment of the present invention provides an LCD device to appropriately cope with the variation of the irrelevance region in position and size. The another embodiment is described with respect to FIG. 7

Figure 7:
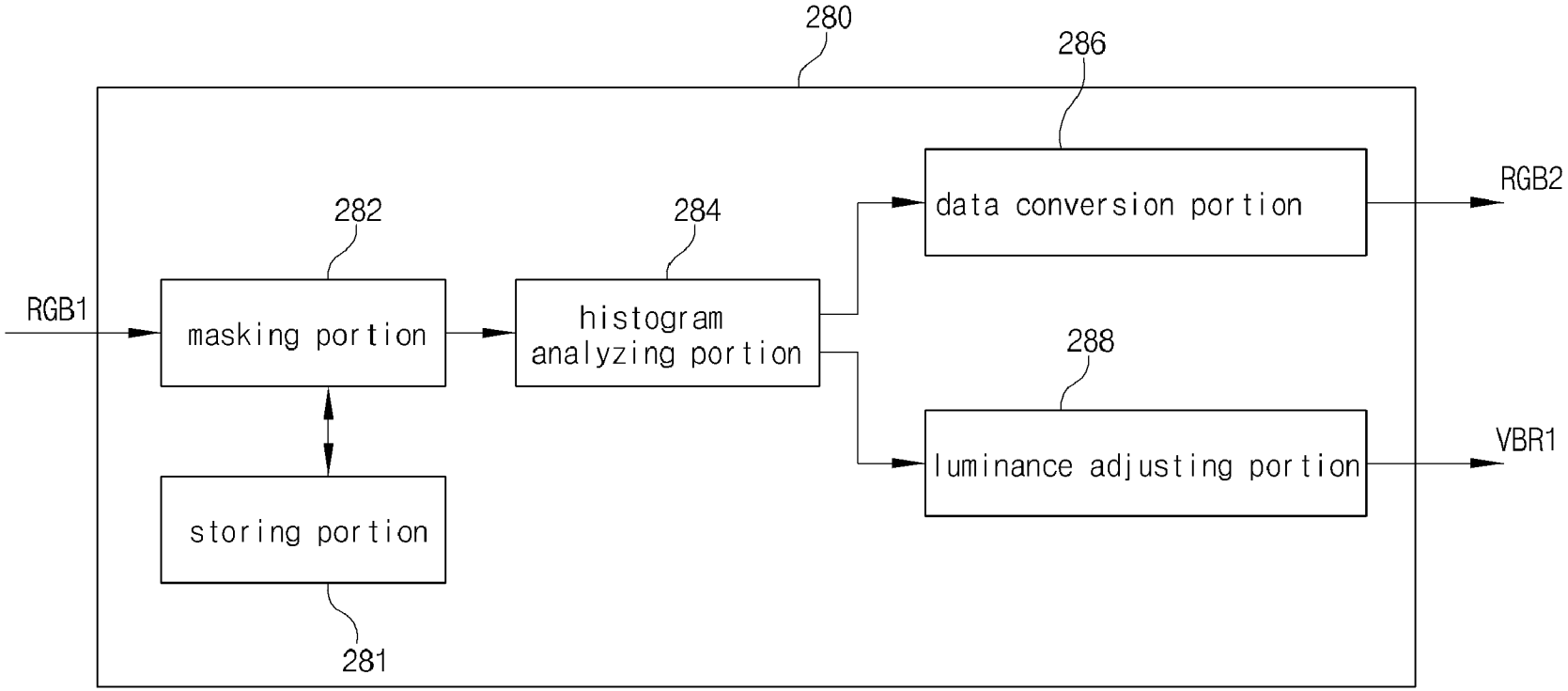
FIG. 7 is a block diagram illustrating a power consumption reduction portion of an LCD device according to a second embodiment of the present invention.

FIG. 7 is a block diagram illustrating a power consumption reduction portion of an LCD device according to a second embodiment of the present invention. The LCD device of the second embodiment is similar to that of the first embodiment. Accordingly, explanations of parts similar to parts of the first embodiment may be omitted.

Referring to FIG. 7, the power consumption reduction portion 280 includes a storing portion 281, a masking portion 282, a histogram analyzing portion 284, a data conversion portion 286 and a luminance adjusting portion 288.

The masking portion 282 detects whether or not an image from an external system includes an irrelevance region. According to the detection of the masking portion 282, a gray level information for first image data RGB1 of a whole region of the image or a gray level information for first image data RGB1 of a region of the image except for an excluded region is transferred to the histogram analyzing portion 284.

In the operation of the masking portion 282, at least one of a detection standard on the irrelevance region and a definition standard on the excluded region may be varied according to type of the image. The detection standard and the definition standard may be stored in the storing portion 281. The storing portion 281 may include a memory device, for example, a ROM (read only memory). Further, the storing portion 281 may include an EEPROM (electrically erasable programmable ROM). Alternatively, the storing portion 281 may include other type of memory device. The storing portion 281 may be communicated with the masking portion 282 through a communication mode, for example, I2C (inter integrated circuit) mode.

The masking portion 282 supplies a signal indicating the type of the image to the storing portion 281. In response to the type of the image, the storing portion 281 supplies a signal indicating at least one of the detection standard and the definition standard back to the masking portion 282. The detection standard may be a standard of at least one of position and size to detect the irrelevance region according to the type of the image. The definition standard may be a standard of at least one of position and size to define the excluded region according to the type of the image.

The histogram analyzing portion 284 makes a histogram from the gray level information from the masking portion 182. According to the histogram analysis, the histogram analyzing portion 184 determines whether or not operating the power consumption reduction mode for the image. For example, when a number of pixels, which have gray levels equal to or more than a reference gray level, is equal to or more than a reference number, not operating the power consumption reduction mode is determined. When a number of pixels, which have gray levels equal to or more than a reference gray level, less than a reference number, operating the power consumption reduction mode is determined. Accordingly, when the power consumption reduction mode is operated, the data conversion and the luminance adjustment are performed, and when the power consumption mode is not operated, and the data conversion and the luminance adjustment are not performed.

The data conversion portion 286 and the luminance adjusting portion 288 outputs second image data RGB2 and a first luminance control signal VBR1 according to the determination of the histogram analyzing portion 284.

As described above, in the LCD device of the second embodiment, the standard on the irrelevance region and the standard on the excluded region can be changed and applied according to the type of the image. Accordingly, various types of images can optimally be displayed in the power consumption reduction mode.

In the embodiments of the present invention as described above, when the image includes the region, which is substantially not degraded even in the power consumption reduction mode, the LCD device can perform the histogram analysis on other region of the image except for the excluded region including at least the irrelevance region. Accordingly, a number of frames displayed in the power consumption reduction mode can increase, and the power consumption of the LCD device can thus be improved.

Further, since the standard on at least one of the irrelevance region and the excluded region is stored in the storing portion, various types of images can be displayed in the power consumption reduction mode.

Further, the irrelevance region is precisely detected, and such the region can defined as the excluded region for the histogram analysis. Accordingly, the excluded region can be minimized, and the power consumption of the LCD device can be further improved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a power consumption reduction portion that analyzes a histogram of first image data of an image and generates second image data and a first luminance control signal, wherein, when the image includes an irrelevance region which is substantially irrelevant to degradation of display quality, the power consumption reduction portion analyzes a histogram of first image data of other region of the image except for an excluded region, and wherein the excluded region includes at least the irrelevance region;

a timing controller that is supplied with the second image data and the first luminance control signal and generates gate control signals, data control signals, and a second luminance control signal;

a gate driving portion that generates gate voltages using the gate control signals;

a data driving portion that generates data voltages using the second image data and the data control signals;

a liquid crystal panel that displays the image using the gate voltages and the data voltages;

a backlight control portion that generates a backlight control signal using the second luminance control signal; and a backlight unit that supplies light according to the backlight control signal, wherein the power consumption reduction portion includes:

a masking portion that detects whether or not the image includes the irrelevant region and outputs a gray level information of first image data of the other region of the image when the image includes the irrelevant region or a gray level information of first image data of the whole region of the image when the image does not include the irrelevant region, a histogram analyzing portion that makes a histogram based upon the gray level information from the masking portion and determines whether or not operating a power consumption reduction mode, a data conversion portion that generates the second image data according to the determination of the histogram analyzing portion, and a luminance adjusting portion that generates the first luminance control signal according to the determination of the histogram analyzing portion, and wherein the power consumption reduction portion further includes a storing portion that stores at least one of a first standard on detecting the irrelevant region and a second standard on defining the excluded region according to type of the image and supplies the at least one of the first and second standards to the masking portion.

2. The device according to claim 1, wherein, when the image does not include the irrelevance region, the power consumption reduction portion analyzes a histogram of first data signal of a whole region of the image.

3. The device according to claim 1, wherein the excluded region includes the irrelevance region and a predetermined region surrounding the irrelevance region.

4. The device according to claim 1, wherein the excluded region is the irrelevance region.

5. The device according to claim 1, wherein the irrelevant region is defined as a region where at least one of a caption and a logo are located.

6. The device according to claim 1, wherein the storing portion includes an EEPROM (electrically erasable programmable read only memory), and is communicated with the masking portion through an I2C (inter integrated circuit) communication mode.

7. The method according to claim 1, wherein, when a number of pixels of the image, gray levels of which are equal to or more than a reference gray level, is equal to or more than a reference number in the histogram analysis, the second image data are the first image data and the backlight unit emits light of a normal luminance of the light, and, when a number of pixels of the image, gray levels of which are equal to or more than the reference gray level, is less than the reference number in the histogram analysis, the first image data is converted into the second image data and the backlight unit emits light of a luminance which is less than the normal luminance.

8. A method of driving a liquid crystal display device, comprising:

detecting whether or not an image having first image data includes an irrelevance region using a masking portion of the liquid crystal display device, wherein the irrelevance region is substantially irrelevant to degradation of display quality;

analyzing a histogram of first image data of other region of the image except for an excluded region when the image includes the irrelevance region and a histogram of first image data of a whole region of the image when the image does not include the irrelevance region, wherein the excluded region includes at least the irrelevance region;

generating second image data and a first luminance control signal according to the histogram analysis;

displaying the image on a liquid crystal panel using the second image data; and supplying light from a backlight unit to the liquid crystal panel using the first luminance control signal, wherein the liquid crystal display device includes a storing portion that stores at least one of a first standard on detecting the irrelevant region and a second standard on defining the excluded region according to type of the image and supplies the at least one of the first and second standards to the masking portion.

* * * * *